US011219281B1

(12) United States Patent
Lee

(10) Patent No.: US 11,219,281 B1
(45) Date of Patent: Jan. 11, 2022

(54) BUCKLE ASSEMBLY

(71) Applicant: Duraflex Hong Kong Limited, Hong Kong (CN)

(72) Inventor: Ray Lee, Taipei (TW)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/116,020

(22) Filed: Dec. 9, 2020

(51) Int. Cl.
*A44B 11/26* (2006.01)

(52) U.S. Cl.
CPC ..... *A44B 11/266* (2013.01)

(58) Field of Classification Search
CPC ..... Y10T 24/45524; Y10T 24/45534
See application file for complete search history.

(56) References Cited

U.S. PATENT DOCUMENTS 5,791,026 A 8/1998 Anscher
D401,533 S 11/1998 Anscher
D425,443 S 5/2000 Anscher
6,311,374 B1 * 11/2001 Anscher ..... A44B 11/263 24/625
7,650,676 B2 * 1/2010 Saitsu ..... A44B 11/2534 24/615
8,286,312 B2 * 10/2012 Paik ..... A44B 11/266 24/614
8,365,368 B2 * 2/2013 Kaneko ..... A44B 11/266 24/625
9,930,937 B2 * 4/2018 Nanbu ..... A44B 11/266

* cited by examiner

*Primary Examiner* — Robert Sandy
(74) *Attorney, Agent, or Firm* — Collard & Roe, P.C.

(57) ABSTRACT

A buckle assembly formed of a male buckle portion and a female buckle portion. The female buckle portion has a top wall, a bottom wall, side walls, and a cavity between the top wall and the bottom wall and a locking slot in each of the side walls. The male buckle portion has a base, two locking legs, a center leg, and two intermediate legs between the locking legs and the center leg. The locking legs extend through the locking slots in the female portion, and locking pawls at the end of the locking legs engage the edges of the locking slots to secure the buckle portions together. Each locking leg is connected to a flexible retaining member that prevents the locking legs from being flexed outwardly beyond a predetermined point. The intermediate legs and/or the retaining members form stop surfaces that prevent the locking legs from being flexed inwardly beyond a point of contact with the stop surfaces.

15 Claims, 6 Drawing Sheets

BUCKLE ASSEMBLY

BACKGROUND OF THE INVENTION

1. Field of the Invention

This invention relates to a two-piece buckle assembly for connecting two straps together. In particular, the invention relates to a buckle assembly having securing elements that prevent excessive outward flexing of legs of one of the buckle portions.

2. The Prior Art

Two-piece side release buckles are normally formed of a male buckle portion and a female buckle portion. The male buckle portion generally has two locking legs that lock into locking slots on the female buckle portion. Often a central leg in the male portion adds stability to the assembly. In order to prevent the locking legs from being flexed outwardly beyond a certain point, U.S. Pat. No. 5,791,026 proposes to have flexible retaining members that connect the locking legs to the central leg, so that the locking legs cannot be flexed outwardly beyond the length of the retaining members. Additional variations of this type of buckle are also shown in U.S. Design Pat. Nos. D401,533 and D425,443.

While these are effective in controlling the motion of the locking legs, it would be desirable to construct a buckle in which the central leg is not affected by the motion of the side locking legs and in which excess inward force on the locking legs can be counteracted as well.

SUMMARY OF THE INVENTION

The invention therefore relates to a buckle assembly formed of a male buckle portion and a female buckle portion, wherein the female buckle portion comprises a top wall, a bottom wall connected to the top wall by opposing side walls, with a cavity between the top wall and the bottom wall, an insertion opening, and a locking slot in each of the side walls. The male buckle portion is configured to be locked to the female buckle portion by inserting the male buckle portion into the insertion opening. The male buckle portion has a base, two locking legs, a center leg, and two intermediate legs between the locking legs and the center leg. Each of the locking legs is configured to extend through a corresponding one of the locking slots in the female portion when the male portion is inserted into the female portion, and locking pawls at the end of each of the locking legs engage the edges of the locking slots to secure the male buckle portion to the female buckle portion. The male buckle portion is released by pressing the locking pawls inward until they clear the edges of the locking slots, at which point the male buckle portion is forced out of the female buckle portion.

Each of the locking legs are connected to another part of the male portion by a flexible retaining member, which can be formed as a connecting strap. The retaining members prevent the locking legs from being flexed outwardly beyond a predetermined point, as the locking legs cannot be flexed outwardly beyond the length of the retaining members. When normal inward force exerts on the two locking legs to release the male buckle portion from the female buckle portion, the flexible retaining members deform, producing minimal resistance to the inward flexing of the locking legs. But when excess inward force is exerted and the two locking legs are bent and pushed into contact with the intermediate legs, the intermediate legs provide support to the locking legs and share the force, forming a stop surface, and thus prevent the locking legs from bending beyond their breaking point. The intermediate legs preferably have an outer contour that matches the inner contour of the locking legs, to minimize friction when the locking legs are pressed inward against the intermediate legs.

In a preferred embodiment, the intermediate legs are connected to the base portion of the male buckle portion and extend substantially parallel to the locking legs. The retaining members are attached to free ends of the locking legs and to a base of the intermediate legs. However, the retaining members can be attached to the locking legs and intermediate legs at any point on the locking legs and intermediate legs, or can be connected to other areas of the male portion. In one embodiment, the retaining members are attached to the intermediate legs on a side of each intermediate leg that faces the center leg, so that the retaining members extend up and over the top of the intermediate legs before connecting to the locking legs. This way, the retaining member does not interfere with any of the inward movement of the locking legs during disengagement of the male buckle portion from the female buckle portion.

The retaining members are preferably integrally molded in one piece with the locking legs and are formed from the same material as the rest of the buckle assembly. The retaining members are molded to be thin enough so as to be flexible. The intermediate legs are formed so that they have a higher degree of stiffness than the retaining members, so that only the retaining members move, and the intermediate legs do not move when the locking legs are flexed inward and outward. To do this, the intermediate legs are made to be thicker than the retaining members. Connecting the retaining members to the base of the intermediate legs also assists in keeping the intermediate legs from bending during flexing of the locking legs. The base of the intermediate legs can be thicker than the rest of the intermediate legs, to assist in keeping the intermediate legs stable during use of the buckle assembly.

In one embodiment, the female buckle portion has an aperture opposite the insertion opening, and the central leg has a foot member on a distal end thereof, and the foot member extends through the aperture when the male buckle portion and the female buckle portion are locked together.

In another embodiment, the retaining members are not connected to the intermediate legs, but instead extend over and around the intermediate legs, without contacting the intermediate legs. In this embodiment, the intermediate legs have hooks on their distal ends, and the retaining members are formed by corresponding hooks on the locking legs. Upon outward flexing of the locking legs, the hooks on the locking legs engage the hooks on the intermediate legs to prevent further outward flexing of the locking legs.

In a further embodiment, the retaining members in the form of the hooks that engage the intermediate legs are also connected to the central leg of the male buckle, to provide further stability and resistance to outward flexing.

In yet another embodiment, the intermediate legs are connected to and extend inward from the locking legs, and the retaining members extend from the locking pawls around the intermediate legs, make a U-turn, and are connected to the central leg. Outward flexing of the locking legs causes the retaining members to press against the underside of the intermediate legs and prevent excessive outward bending of the locking legs.

The buckle assembly according to the present invention is configured to allow the attachment of a strap to each of the buckle portions, so that attaching the buckle portions together connects the two straps. To accomplish this, each of the male and female buckle portions has at least one strap retaining bar connected thereto. The strap can be sewn closed around a single strap retaining bar, or can be wrapped around a double-bar arrangement so as to be adjustable.

In summary, the two intermediate legs, together with the flexible retaining members, can effectively prevent the legs of the male buckle from being excessively bent in any direction and being damaged. The new design improves the strength, stability and durability of the buckle.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE EMBODIMENTS

Figure 1:
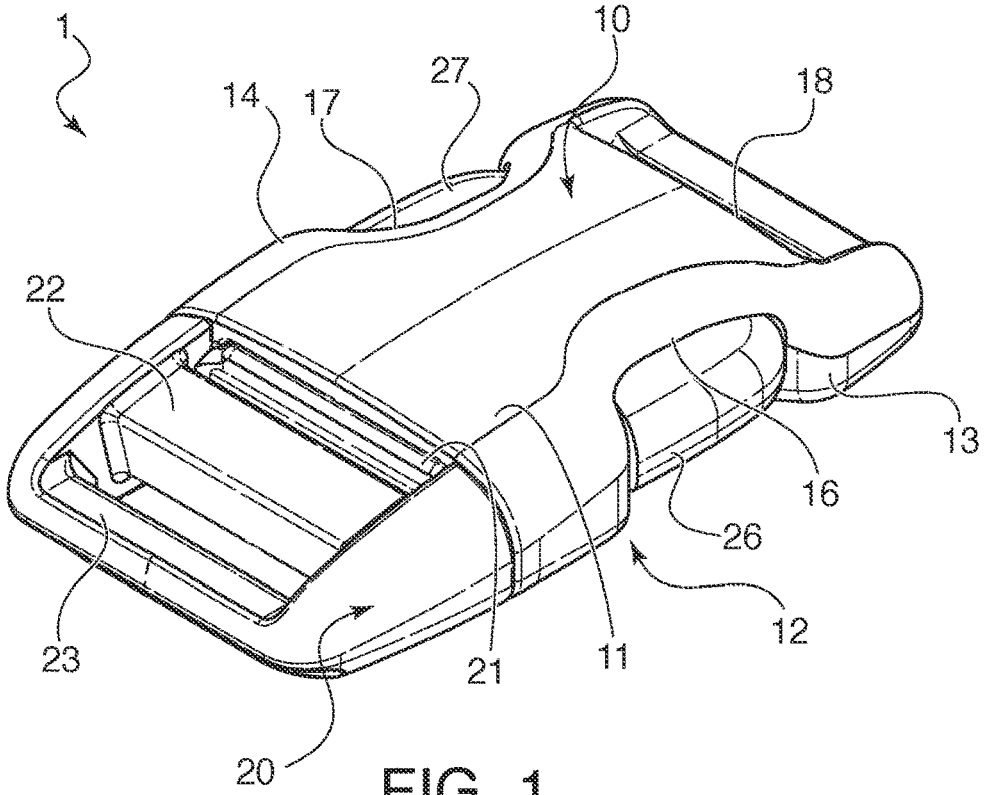
FIG. 1 shows a perspective view of the assembled buckle assembly according to the invention.
Figure 2:
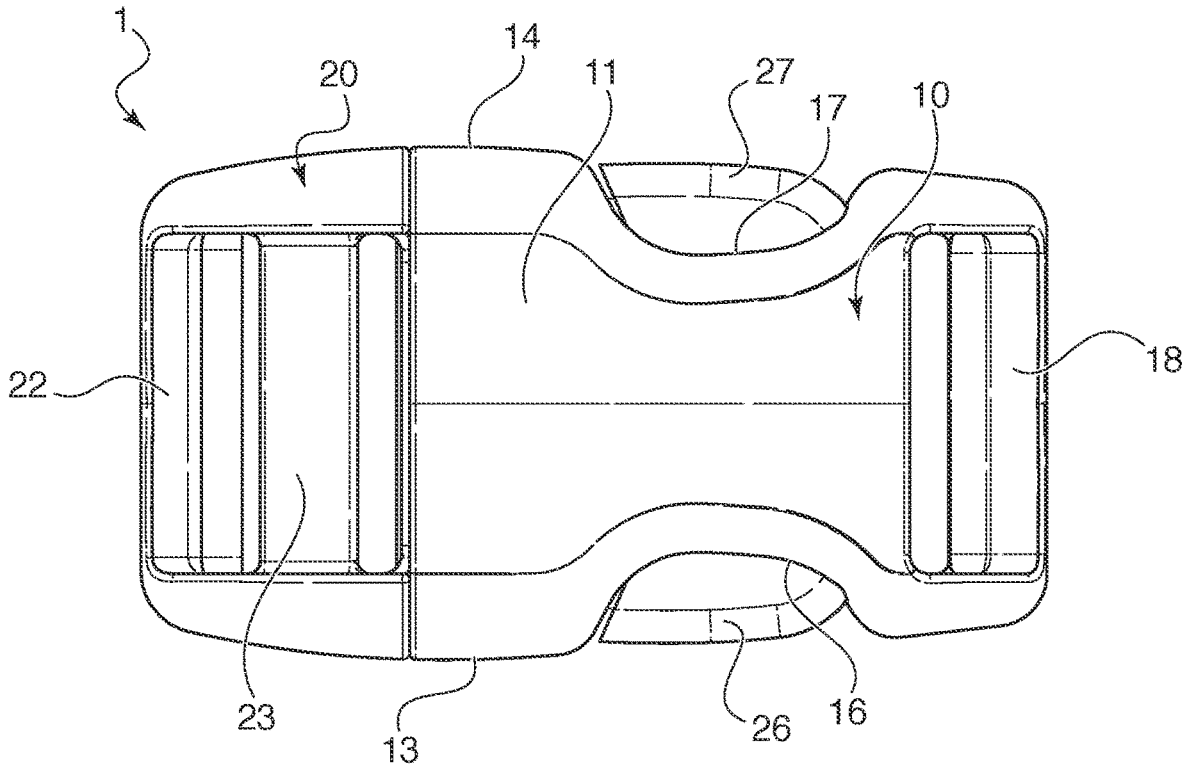
FIG. 2 is a top view of the buckle assembly.

Referring now in detail to the drawings, FIGS. 1 and 2 show buckle assembly 1 according to the invention, which consists of female buckle portion 10 and male buckle portion 20. Female buckle portion 10 comprises a top wall 11, a bottom wall 12, and opposing side walls 13, 14. A cavity 15, bounded by an opening 115, shown in FIG. 3, extends between top wall 11 and bottom wall 12. Locking slots 16, 17 are disposed in side walls 13, 14 respectively. A strap retaining bar 18 is connected at an end of female buckle portion 10 that is opposite from opening 115.

Figure 3:
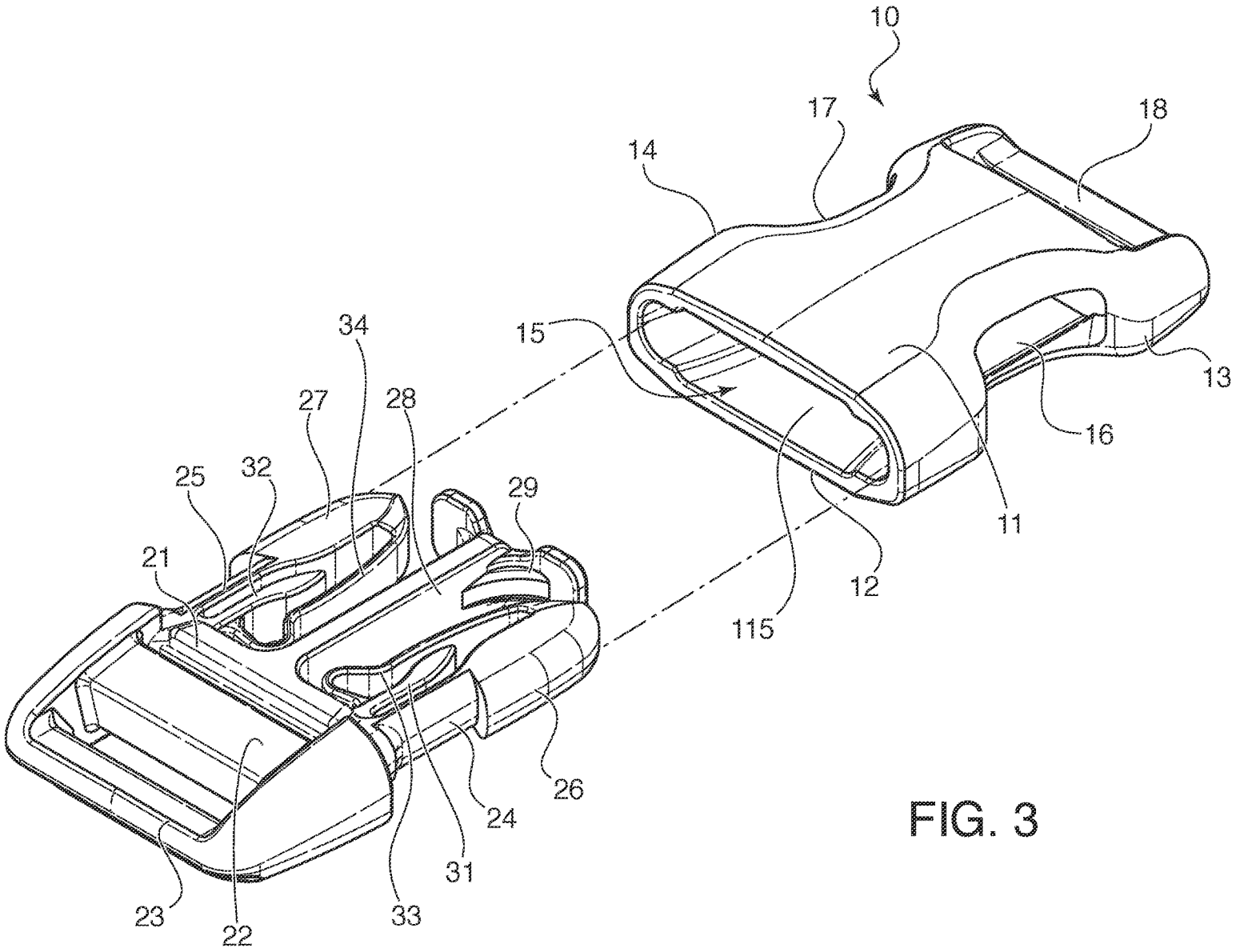
FIG. 3 is an exploded view of the buckle assembly, showing the male and female buckle portions in an unassembled state.
Figure 4:
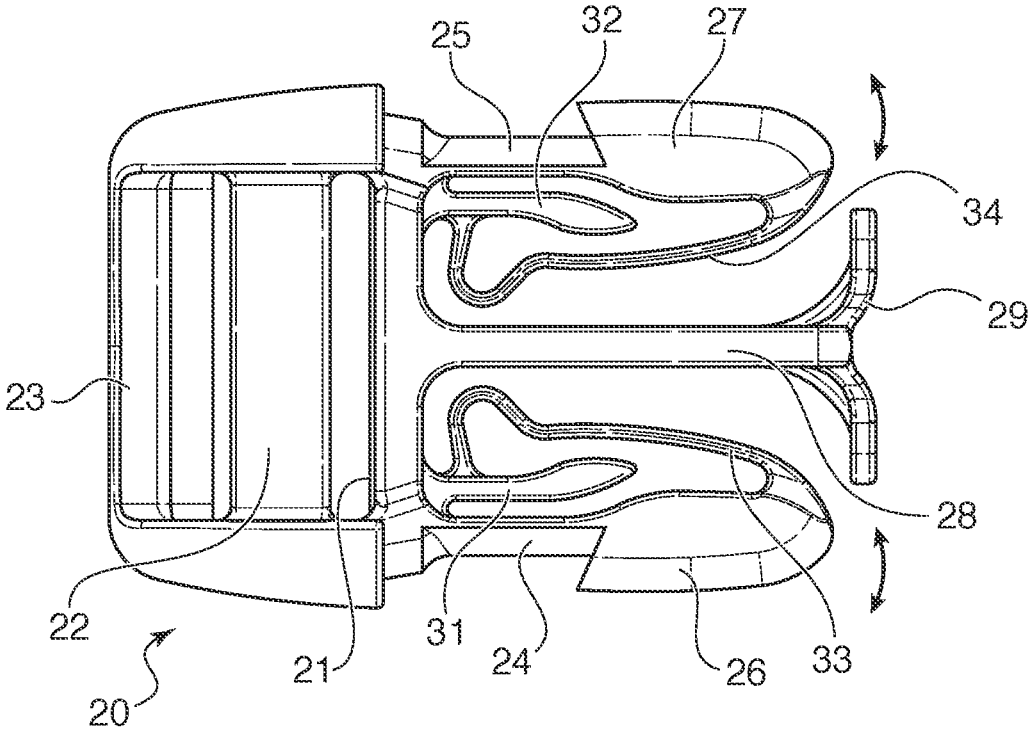
FIG. 4 is a top view of the male buckle portion according to the invention.
Figure 5:
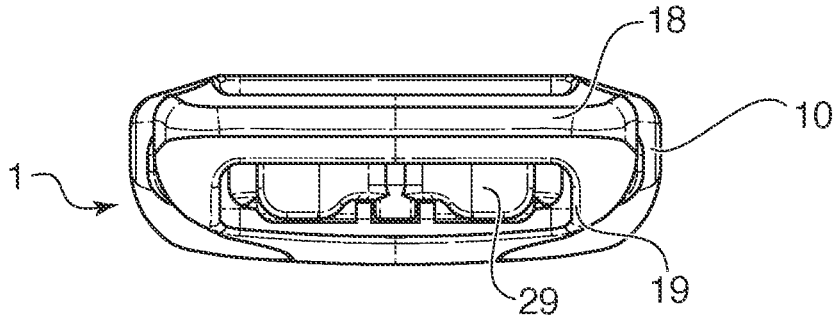
FIG. 5 is an end view of the buckle assembly according to the invention.

As shown in FIGS. 3-5, male portion 20 is formed from a base 21 connected to strap retaining bars 22, 23, on one side, and to locking legs 24, 25 extending from the other side. Locking legs 24, 25 end in locking pawls 26, 27, which snap into locking slots 16, 17 in female buckle portion 10 when male buckle portion 20 is inserted into female buckle portion 10. Pressing locking pawls 26, 27 inwardly until they clear the edges of locking slots 16, 17 releases male buckle portion 20 from female buckle portion 10 by forcing male buckle portion 10 out of cavity 15.

As shown in FIGS. 3 and 4, male buckle portion 20 has a central leg 28, ending in a foot member 29. When assembled with female buckle portion 10, foot member extends to the end of cavity 15 and serves to further stabilize male buckle portion 20 inside of female buckle portion 10. Foot member 29 can be seen through aperture 19 in female portion 10 when the buckle portions are assembled, as shown in FIG. 5.

In between central leg 28 and locking legs 24, 25 are disposed two intermediate legs 31, 32. Intermediate legs 31, 32 extend up from base 11 and are smaller than locking legs 24, 25, both in width and height. The side of intermediate legs 31, 32 that face locking legs 24, 25 are slightly curved and follow the contour of the inner side of the locking legs 24, 25, so that excess friction and resistance can be avoided when locking legs are pressed against intermediate legs 31, 32 under strong forces, causing the intermediate legs 31, 32 to form a stop surface beyond which the locking legs 24, 25 cannot pass.

Connected to intermediate legs 31, 32 are flexible retaining members 33, 34. Flexible retaining members 33, 34 are connected to intermediate legs 31, 32 at their base on a side facing central leg 28, and are connected to locking legs 24, 25 at the top of locking pawls 26, 27 on a side facing central leg 28. Inward pressure on locking pawls 26, 27 causes locking legs 24, 25 to bend inward and contact intermediate legs 31, 32, which serve to stabilize locking legs 24, 25 and prevent excessive inward motion that might damage the buckle portion. Outward pressure on locking legs 24, 25 is compensated by flexible retaining members 33, 34, which only allow outward flexing up to a predetermined amount, due to the length and rigidity of the material of the retaining members 33, 34. Retaining members 33, 34 are disposed on the inside faces of locking pawls 26, 27 and of intermediate legs 31, 32, so that they do not interfere with any inward motion by locking legs 24, 25. Retaining members 33, 34 are integrally molded in one piece with intermediate legs 31, 32 and locking pawls 26, 27 and are molded thin enough so as to allow locking legs 24, 25 to flex in the inward direction, and in the outward direction but in a limited manner.

Figure 6:
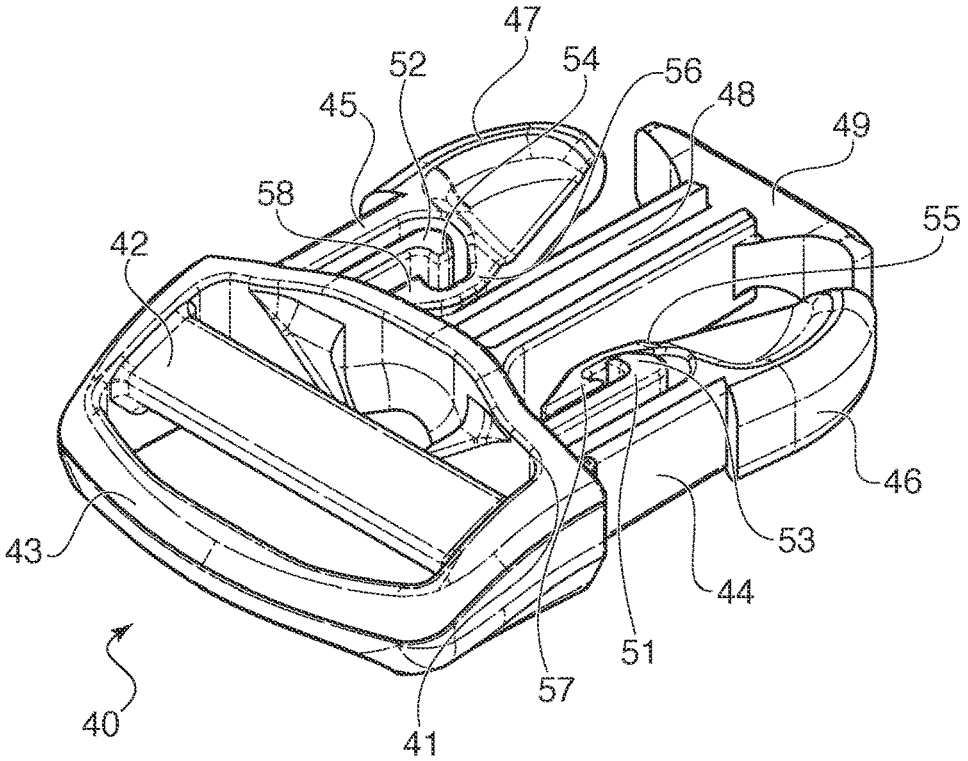
FIG. 6 is a perspective view of an alternative embodiment of the male buckle portion according to the invention.
Figure 7:
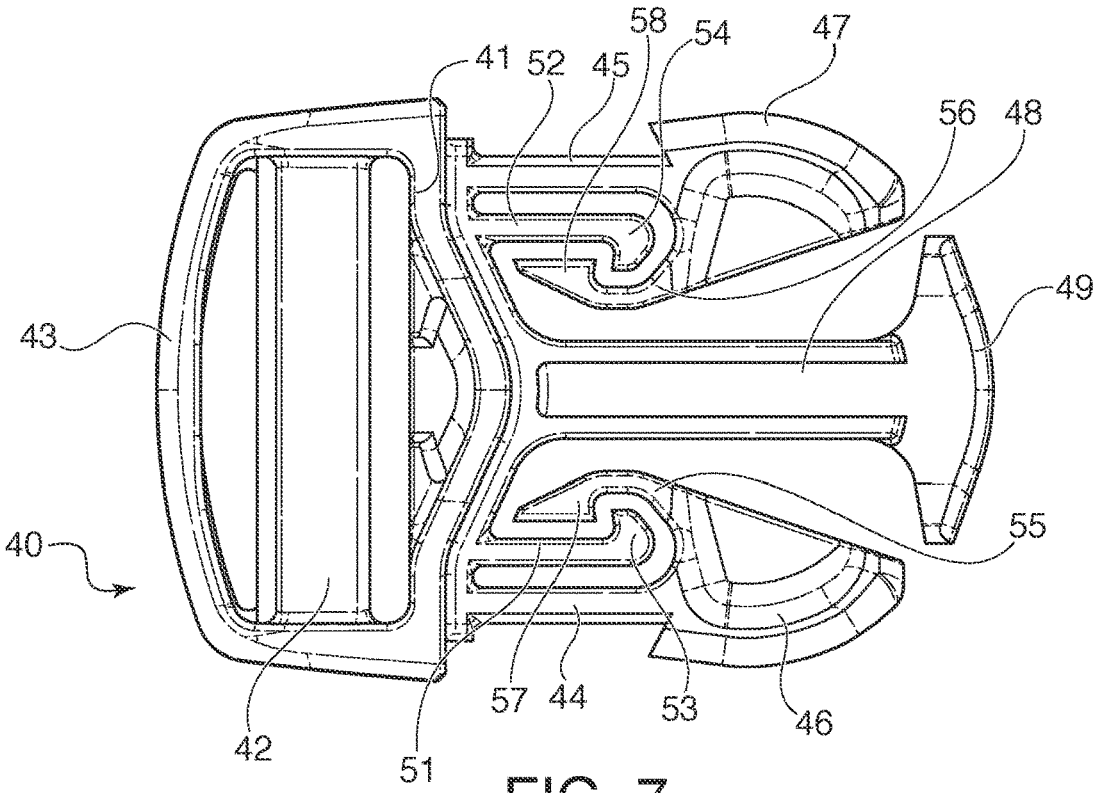
FIG. 7 is a top view of the embodiment of FIG. 6.

Alternative embodiments of the male buckle portion can be seen in FIGS. 6-11. In FIGS. 6 and 7, male portion 40 is formed from a base 41 connected to strap retaining bars 42, 43, on one side, and to locking legs 44, 45 extending from the other side. Locking legs 44, 45 end in locking pawls 46, 47, which snap into locking slots 16, 17 in female buckle portion 10 when male buckle portion 40 is inserted into female buckle portion 10. Pressing locking pawls 46, 47 inwardly until they clear the edges of locking slots 16, 17 releases male buckle portion 40 from female buckle portion 10 by forcing male buckle portion 10 out of cavity 15, in the same manner as with male portion 20, above.

Male buckle portion 40 has a central leg 48, ending in a foot member 49. In between central leg 48 and locking legs 44, 45 are disposed two intermediate legs 51, 52. Intermediate legs 51, 52 extend up from base 41 and are smaller than locking legs 44, 45, both in width and height. Intermediate legs 51, 52 form a stop surface beyond which the locking legs 44, 45 cannot pass when locking legs 44, 45 are pressed inwardly.

Connected to locking legs 44, 45 are flexible retaining members 55, 56. Inward pressure on locking pawls 46, 47 causes locking legs 44, 45 to bend inward and contact intermediate legs 51, 52, which serve to stabilize locking legs 44, 45 and prevent excessive inward motion that might damage the buckle portion. Flexible retaining members 55, 56 have free ends that terminate in hooks 57, 58, and intermediate legs 51, 52, have corresponding hooks 53, 54 on their free ends. Outward pressure on locking legs 44, 45 causes hooks 57, 58 to engage hooks 53, 54, respectively and prevent any further outward movement of locking legs 44, 45. Retaining members 55, 56 extend around and engage hooks 53, 54 on the side of intermediate legs 51, 52 that face central leg 48 so that retaining members 55, 56 do not interfere with inward motion of locking legs 44, 45. Retaining members 55, 56 are integrally molded in one piece with locking pawls 46, 47.

Figure 8:
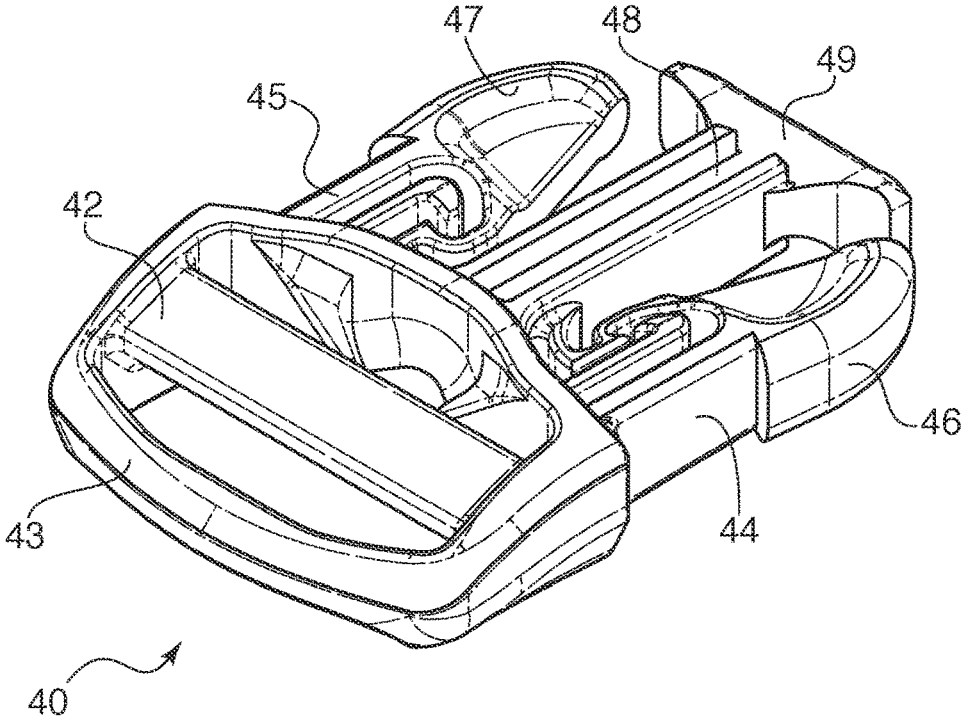
FIG. 8 is a perspective view of an alternative embodiment of the male buckle portion according to the invention.
Figure 9:
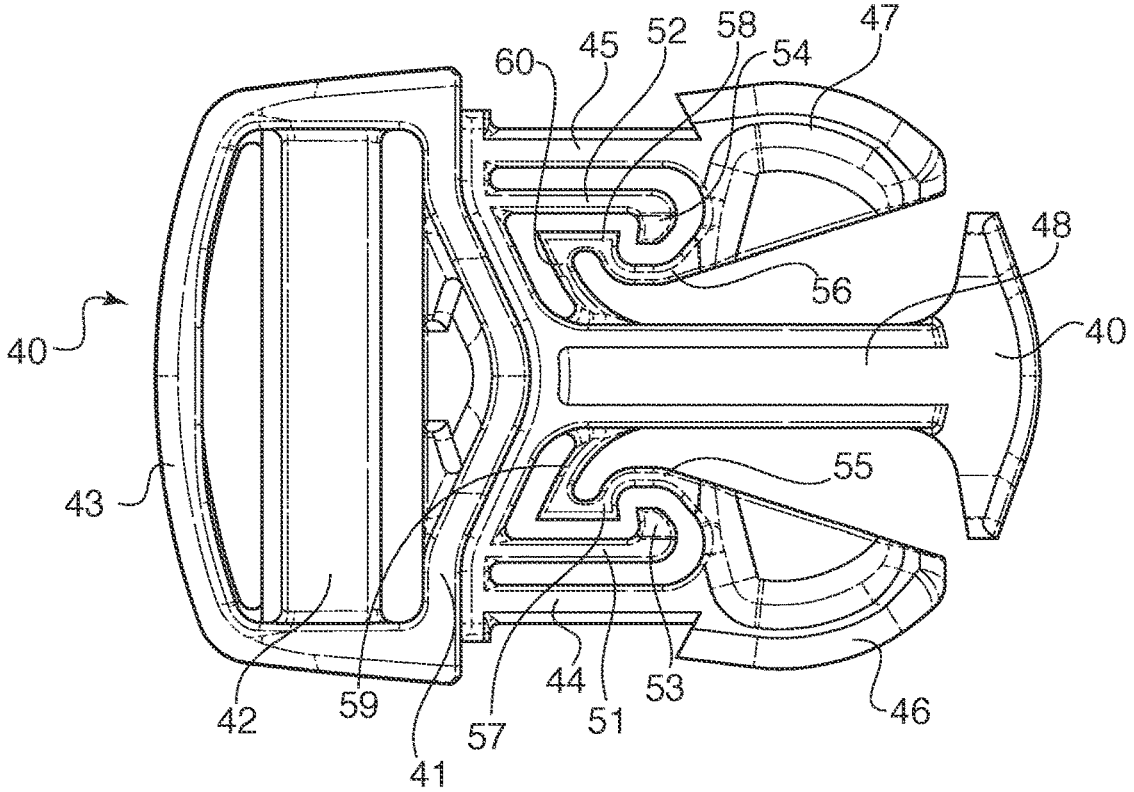
FIG. 9 is a top view of the embodiment of FIG. 8.

FIGS. 8 and 9 show another embodiment, which is based on the embodiment of FIGS. 6 and 7, and follows the same numbering for the same elements. In this embodiment however, flexible retaining member 55 has an extension 59 that extends from hook 57 and attaches directly to central leg 48. Similarly, flexible retaining member 56 has an extension 60 that extends from hook 58 and attaches directly to central leg 48. These extensions add additional stability to flexible retaining member 55, 56, to prevent inadvertent breakage. As described above with respect to FIGS. 6 and 7, outward flexing of locking legs 44, 45 causes hooks 57, 58 to engage hooks 53, 54 to prevent further outward movement of locking legs 44, 45.

Figure 10:
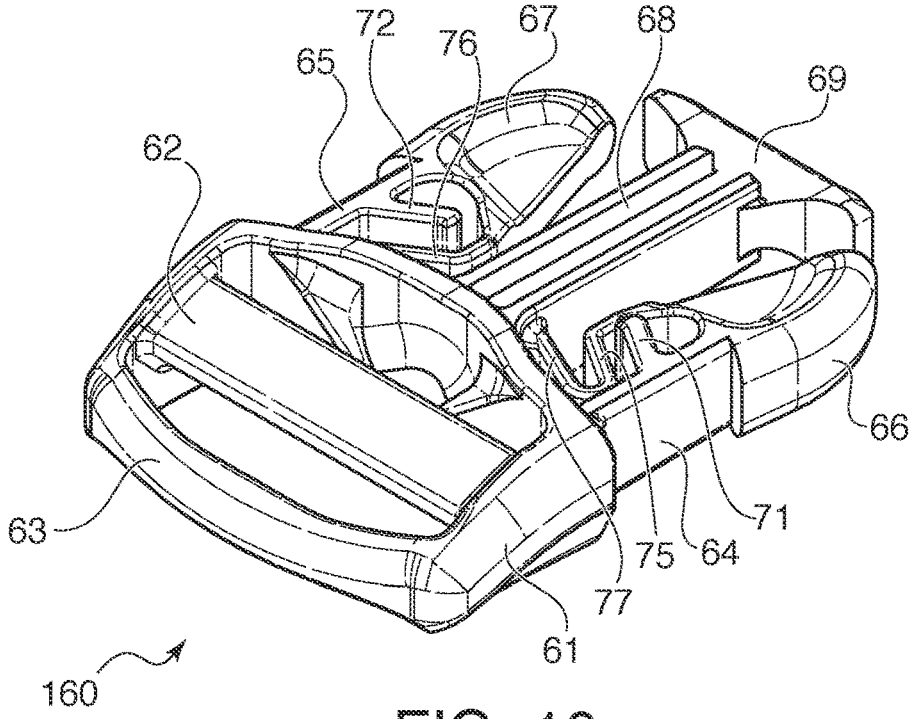
FIG. 10 is a perspective view of another alternative embodiment of the male buckle portion according to the invention.
Figure 11:
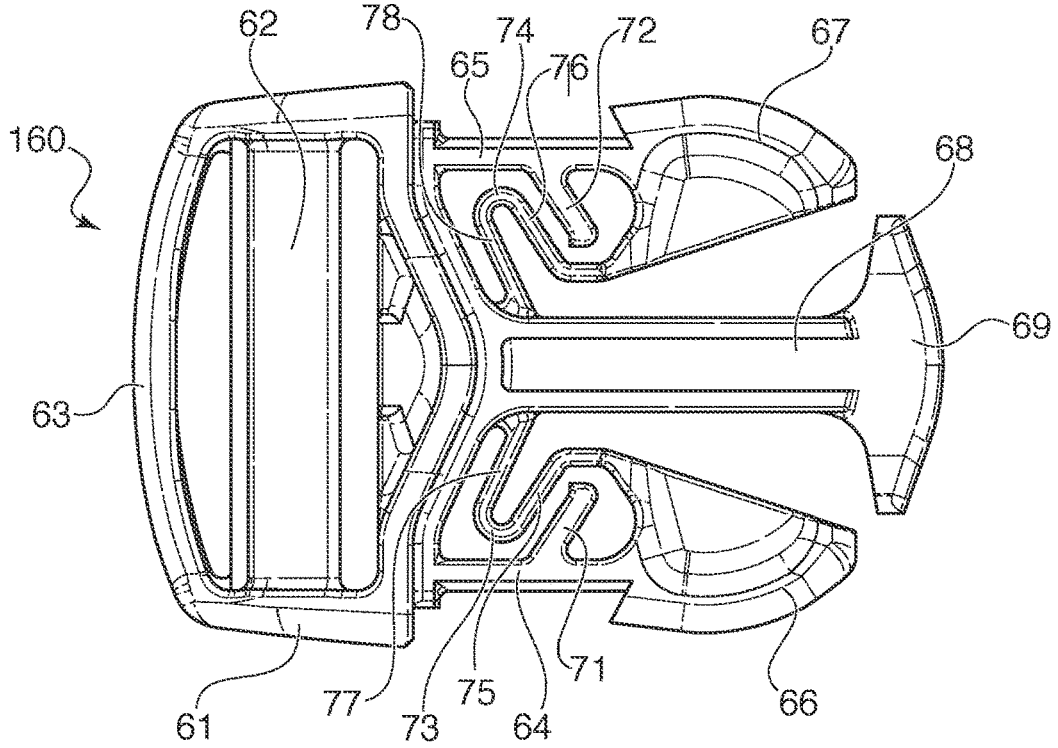
FIG. 11 is a top view of the embodiment of FIG. 10.

FIGS. 10 and 11 show another alternative embodiment of the buckle assembly according to the invention. In this embodiment, male portion 160 is formed from a base 61 connected to strap retaining bars 62, 63, on one side, and to locking legs 64, 65 extending from the other side. Locking legs 64, 65 end in locking pawls 66, 67, which snap into locking slots 16, 17 in female buckle portion 10 when male buckle portion 160 is inserted into female buckle portion 10. Pressing locking pawls 66, 67 inwardly until they clear the edges of locking slots 16, 17 releases male buckle portion 160 from female buckle portion 10 by forcing male buckle portion 160 out of cavity 15, in the same manner as with male portions 20 and 40, above.

Male buckle portion 160 has a central leg 68, ending in a foot member 69. Attached to locking legs 64, 65 are two intermediate legs 71, 72, which extend inwardly from locking legs 64, 65.

Connected to locking pawls 66, 67 are flexible retaining members 73, 74, which extend in a U-shape and connect to central leg 68. Retaining member 73 is formed by parallel legs 75, 77 and retaining member 74 is formed by parallel legs 76, 78. Inward pressure on locking pawls 66, 67 causes locking legs 64, 65 to bend inward, at which point retaining members 73, 74 are pushed toward central leg 68 and contact central leg 68, preventing further inward motion that might damage the buckle portion. Outward pressure on locking legs 64, 65 causes legs 75, 76 of retaining members 73, 74 to press upward against intermediate legs 71, 72 and prevent further outward flexing of locking legs 64, 65, thus protecting locking legs 64, 65 from damage. Retaining members 73, 74 are integrally molded in one piece with locking pawls 66, 67 and with central leg 68.

Accordingly, while only a few embodiments of the present invention have been shown and described, it is obvious that many changes and modifications may be made thereunto without departing from the spirit and scope of the invention.

What is claimed is:

1. A buckle assembly comprising:

a female buckle portion comprising a top wall, a bottom wall connected to the top wall by opposing side walls, with a cavity between the top wall and the bottom wall, an insertion opening, and a locking slot in each of the side walls;

a male buckle portion configured to be locked to the female buckle portion by inserting the male buckle portion into the insertion opening, the male buckle portion comprising a base, two locking legs, and two intermediate legs arranged between the two locking legs, wherein each of the locking legs is configured to extend through a corresponding one of the locking slots in the female portion when the buckle portions are locked together, wherein each of the locking legs is connected to a respective one of two retaining members that prevent the locking legs from being flexed outwardly beyond a predetermined point, and wherein the intermediate legs and retaining members are arranged such that the intermediate legs or retaining members form a stop surface when inward pressure is applied to the locking legs, so as to prevent inward movement of the locking legs when the stop surface is contacted, and wherein the retaining members are attached to free ends of the locking legs.

2. The buckle assembly according to claim 1, further comprising a central leg extending between the two intermediate legs, so that each one of the intermediate legs is disposed between one of the locking legs and the central leg.

3. The buckle assembly according to claim 1, wherein the intermediate legs are connected to the base and extend parallel to the locking legs.

4. A buckle assembly comprising:

a female buckle portion comprising a top wall, a bottom wall connected to the top wall by opposing side walls, with a cavity between the top wall and the bottom wall, an insertion opening, and a locking slot in each of the side walls;

a male buckle portion configured to be locked to the female buckle portion by inserting the male buckle portion into the insertion opening, the male buckle portion comprising a base, two locking legs, and two intermediate legs arranged between the two locking legs, wherein each of the locking legs is configured to extend through a corresponding one of the locking slots in the female portion when the buckle portions are locked together, wherein each of the locking legs is connected to a retaining member that prevents the locking legs from being flexed outwardly beyond a predetermined point, and wherein the intermediate legs and retaining members are arranged such that the intermediate legs or retaining members form a stop surface when inward pressure is applied to the locking legs, so as to prevent inward movement of the locking legs when the stop surface is contacted, wherein each intermediate leg is connected to an adjacent one of the locking legs.

5. The buckle assembly according to claim 4, further comprising a central leg extending between the two intermediate legs, wherein each one of the intermediate legs is disposed between one of the locking legs and the central leg, and wherein each one of the retaining members is connected to the central leg.

6. The buckle assembly according to claim 1, wherein the retaining members are attached to the intermediate legs.

7. The buckle assembly according to claim 6, wherein the retaining members are attached to the intermediate legs on a side of each intermediate leg that faces away from an adjacent one of the locking legs.

8. The buckle assembly according to claim 6, wherein the retaining members are integrally molded in one piece with the locking legs and intermediate legs.

9. The buckle assembly according to claim 1, wherein the intermediate legs have a higher level of stiffness than the retaining members, so that the intermediate legs do not move when the locking legs are flexed outward.

10. The buckle assembly according to claim 1, wherein the female buckle portion has an aperture opposite the insertion opening, and wherein the central leg has a foot member on a distal end thereof, and wherein the foot member extends through the aperture when the male buckle portion and the female buckle portion are locked together.

11. The buckle assembly according to claim 1, wherein each of the male and female buckle portions has at least one strap retaining bar connected thereto.

12. A buckle assembly comprising:

a female buckle portion comprising a top wall, a bottom wall connected to the top wall by opposing side walls, with a cavity between the top wall and the bottom wall, an insertion opening, and a locking slot in each of the side walls;

a male buckle portion configured to be locked to the female buckle portion by inserting the male buckle portion into the insertion opening, the male buckle portion comprising a base, two locking legs, and two intermediate legs arranged between the two locking legs, wherein each of the locking legs is configured to extend through a corresponding one of the locking slots in the female portion when the buckle portions are locked together, wherein each of the locking legs is connected to a retaining member that prevents the locking legs from being flexed outwardly beyond a predetermined point, and wherein the intermediate legs and retaining members are arranged such that the intermediate legs or retaining members form a stop surface when inward pressure is applied to the locking legs, so as to prevent inward movement of the locking legs when the stop surface is contacted, wherein each one of the retaining members is configured to engage an adjacent one of the intermediate legs when the locking legs are flexed outwardly, to prevent further outward flexing of the locking legs.

13. The buckle assembly according to claim 12, wherein each one of the intermediate legs has a hook arranged on a distal end thereof; and wherein each one of the flexible retaining members has a hook that is configured to engage the hook of the adjacent intermediate leg when the respective locking leg is flexed outwardly.

14. The buckle assembly according to claim 12, further comprising a central leg extending between the two intermediate legs, so that each one of the intermediate legs is disposed between one of the locking legs and the central leg, wherein each one of the retaining members is connected to the central leg.

15. The buckle assembly according to claim 14, wherein each one of the retaining members has a U-shaped design with two parallel legs, and wherein outward flexing of the locking legs causes one of the parallel legs of each of the retaining members to press against an adjacent one of the intermediate legs to prevent further outward flexing of the locking legs.

* * * * *